US005947345A

United States Patent [19]

Hofmann

[11] Patent Number: 5,947,345

[45] Date of Patent: Sep. 7, 1999

[54] CHILD RESISTANT TELESCOPIC SMALL ITEM DISPENSER

[75] Inventor: Richard W. Hofmann, Chicago, Ill.

[73] Assignee: Magenta Corporation, Chicago, Ill.

[21] Appl. No.: 09/083,813

[22] Filed: May 22, 1998

[51] Int. Cl.[6] ..... B67D 5/33

[52] U.S. Cl. ..... 222/519; 222/153.14; 221/154; 221/306

[58] Field of Search ..... 222/519, 522, 222/153.14; 221/154, 306

[56] References Cited

U.S. PATENT DOCUMENTS

| | | | |
|---|---|---|---|
| 4,971,203 | 11/1990 | Weinstein . | |
| 5,038,967 | 8/1991 | Braun | 222/519 |
| 5,141,129 | 8/1992 | Jennings | 222/519 |
| 5,372,267 | 12/1994 | Hofmann . | |
| 5,579,933 | 12/1996 | Hofmann . | |

*Primary Examiner*—Philippe Derakshani
*Attorney, Agent, or Firm*—Laff, Whitesel, Conte & Saret, Ltd.; Robert F. I. Conte

[57] ABSTRACT

A dispenser having a tubular closure and a tubular container body. The closure has an open end and an axially opposite closed end. The closure has an annular side wall. The container body has a closed end and an opening longitudinally spaced from the closed end. The container body has an annular side wall. The closure is adjustably and telescopically coupled to the container so that the closure side wall remains adjacent to the container body side wall during an adjustment of the closure from a closed rotationally locked position to a closed rotationally unlocked position, to an alignment position, and to an open position. The dispenser utilizes rotational quadrants to control adjustment of the closure. The rotational quadrants are formed by the closure and container body. Each rotational quadrant includes a plurality of interferences, a first lateral passage, a first vertical passage, a helical guide, and a longitudinal guide.

9 Claims, 10 Drawing Sheets

1/10

CHILD RESISTANT TELESCOPIC SMALL ITEM DISPENSER

FIELD OF INVENTION

The present invention concerns a dispenser having a closure telescopically adjustable and rotationally adjustable relative to a container so that the closure can be adjusted to an open position to create a pill dispensing opening and readjusted to close the pill dispensing opening.

BACKGROUND

A variety of medicine containers exist for pills and other small, dry medicines. These containers have a variety of mechanisms to inhibit unwanted users such as children from gaining access to the container.

Many of these types of containers suffer from spillage problems. Users, when removing the closure from the container body or when removing medicine from the container body, often cause an excessive tilting, jarring or dropping of the container. The excessive tilting, jarring or dropping can cause unwanted spillage of the medicine.

To facilitate the opening of these containers, and to facilitate the dispensing of the medicine from these containers, industry has developed telescopic pill dispensers. A known telescopic pill dispenser has a tube-shaped container body. The tube body has an opening longitudinally spaced from a closed end.

A tube-shaped closure is telescopically coupled to the container body. The tube-shaped closure has an open end opposite a closed end. The tube-shaped closure, further, has an opening in a side wall. The tube-shaped closure has its open end telescopically inserted over the container body.

The pill dispenser has an open position, a closed unlocked position, and a closed locked position.

SUMMARY

The present invention desires to provide a telescopic dispenser having a closure with a closed rotationally locked position wherein a pill dispensing opening is closed and the closure cannot be rotated relative to the container body. To obtain a closed rotationally locked position, the invention provides a series of protrusions around the circumference of the container body's neck. A portion of each protrusion forms an outer radius. The closure has an interior closure radius defined by an interior of its side wall which is slightly less than the outer protrusion radius. The difference in the radius lengths causes the protrusions to provide a force on a closure end wall and hold the closure in a direction away from the container body's closed end, thereby placing the closure in a closed, rotationally locked position.

A user can overcome the force holding the closure in the rotationally locked position by applying a force to push the closure toward the container body. If a user, however, lets up on the applied force, a resilient force of the closure side wall causes the closure to reconform. The reconforming causes the closure to slide away from the container body.

The invention further seeks to eliminate the need to have to remember to rotate the closure to place the closure in a closed locked position. The invention eliminates the need to remember to rotate by providing a plurality of helical guides on the container body which cause rotation of the closure as a user pushes the closure toward the container body.

The invention additionally seeks to provide a mechanical rather than a visual signal as to when the container body and the closure are in an aligned position. The container provides the mechanical alignment signal by disposing a plurality of longitudinally running splines along the outer surface of the container body neck. The longitudinally running splines stop the lateral movement of the closure relative to the container. The stopping signals to the user to move the closure longitudinally away from the container body.

Accordingly, provided is a small dry object dispenser having a closure. The closure has an open end and a closed end opposite the open end. The closure includes a closure side wall having an opening. The closure open end has a closure end wall opposite the closure closed end.

The dispenser also includes a container body. The container body has a closed end, an opening which is longitudinally spaced from the closed end, and a container body side wall. The container body encloses a hollow. The container body opening opens into the hollow.

At least one rotational quadrant is formed by the closure and the container body. The quadrant includes a plurality of interferences, a first lateral passage, a first vertical passage, a helical guide, and a longitudinal guide.

The closure is adjustable to an open position and, in the open position, a dispensing opening is formed by the opening in the closure side wall and the container body opening. The closure is adjustable to a closed rotationally locked position and, in the closed rotationally locked position, the dispensing opening is closed and rotation of the closure relative to the container body is inhibited.

The closure is adjustable to a closed rotationally unlocked position and, in the closed rotationally unlocked position, the closure is less rotationally inhibited than when the closure is in the closed rotationally locked position and, in the closed rotationally unlocked position, the closure end wall is longitudinally closer to the container body closed end than when the closure is in the closed rotationally locked position. The closure side wall remains adjacent to the container body side wall during an adjustment of the closure from the closed rotationally locked position, then to the closed rotationally unlocked position, and then to the open position.

The closure includes a closure first interior side wall, said closure first interior side wall being radially inward of the closure side wall. A first portion of the closure first interior side wall has a greater outer diameter than a second adjacent portion of the closure first interior side wall, the second adjacent portion being closer to the closure closed end than the first portion having the greater diameter. In the closed rotationally locked position, the first portion of the closure first interior side wall abuts up against an interior surface of the container body side wall. A clearance exists between the second adjacent portion of the closure first interior side wall and an interior surface of the container body side wall.

There are a plurality of protrusions arranged around an exterior surface of the container body. In the closed rotationally locked position, a portion of each of the plurality of protrusions has an outer radius greater than inner radiuses formed by portions of an interior surface of the closure side wall. In the closed rotationally unlocked position, the portions of the interior surface of the closure side wall are adjacent to portions of the protrusions having the outer radius greater than the inner radius formed by the portions of the interior surface of the closure side wall. The plurality of protrusions provide means for deforming the closure side wall out of a shape when the closure is in the closed rotationally unlocked position. The closure side wall reconforms to the shape when the closure is in the closed rotationally locked position.

The helical guide rotates the closure in a direction opposite a direction of rotation as a user applies a force on the closure to move the closure longitudinally towards the container body.

The longitudinal guide provides a pathway to guide one of the plurality of interferences to abut up against a surface of the helical guide.

The plurality of interferences include two adjacent protrusions which form the first longitudinal passage and two adjacent protrusions which form the first lateral passage. One of the adjacent protrusions forming the first longitudinal passage and one of the two adjacent protrusions forming the first lateral passage are the same.

The interferences also include a protrusion exclusive of the protrusions forming the first longitudinal and first lateral passages. This protrusion forms a second vertical passage with one of the longitudinally extending splines from the pairs of splines. The second vertical passage is part of the rotational quadrant.

A laterally extending chasm is defined by a surface of the container and is adjacent to at least one of the plurality of interferences when the closure is in the closed rotationally unlocked position.

The container further comprises a plurality of pairs of longitudinally extending splines. Each rotational quadrant is laterally bounded by a different pair of these adjacent longitudinally extending splines.

A ledge surface bounds a longitudinal end of the rotational quadrant. The protrusion, exclusive of the protrusions forming the first longitudinal and first lateral passages, and the ledge surface form a second lateral passage which is part of the rotational quadrant.

Other novel features of the invention will be further understood with reference to the below detailed description, the drawings and the appended claims.

DETAILED DESCRIPTION

Figure 1:
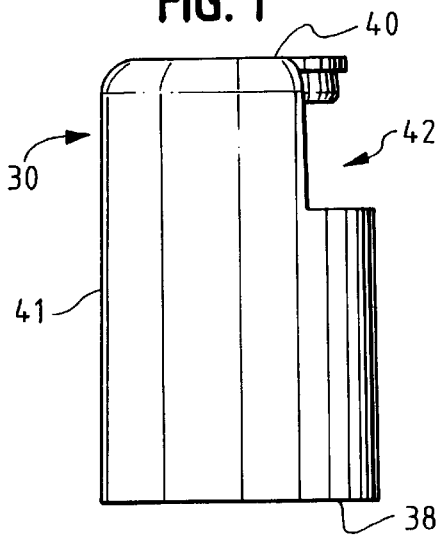
FIG. 1 is a side perspective view of the closure.
Figure 3:
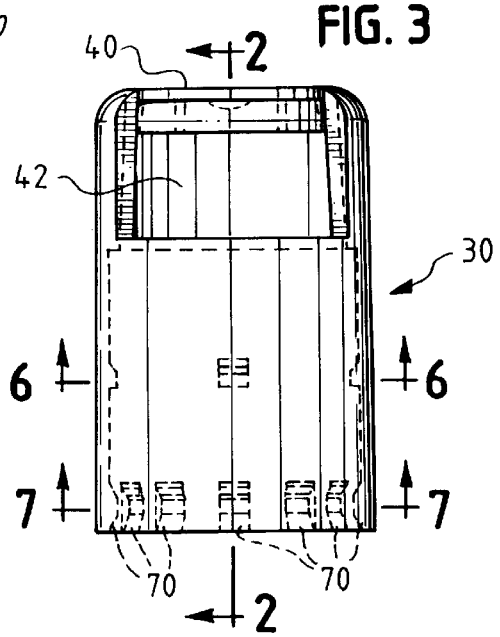
FIG. 3 is a side view of the closure exposing an interior surface of the closure.
Figure 2:
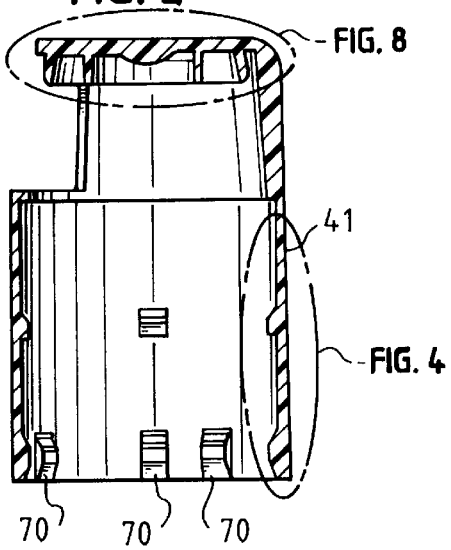
FIG. 2 is a side view of a vertical cross-section of the closure wherein the cross-section is taken along view lines A—A of FIG. 3.
Figure 9:
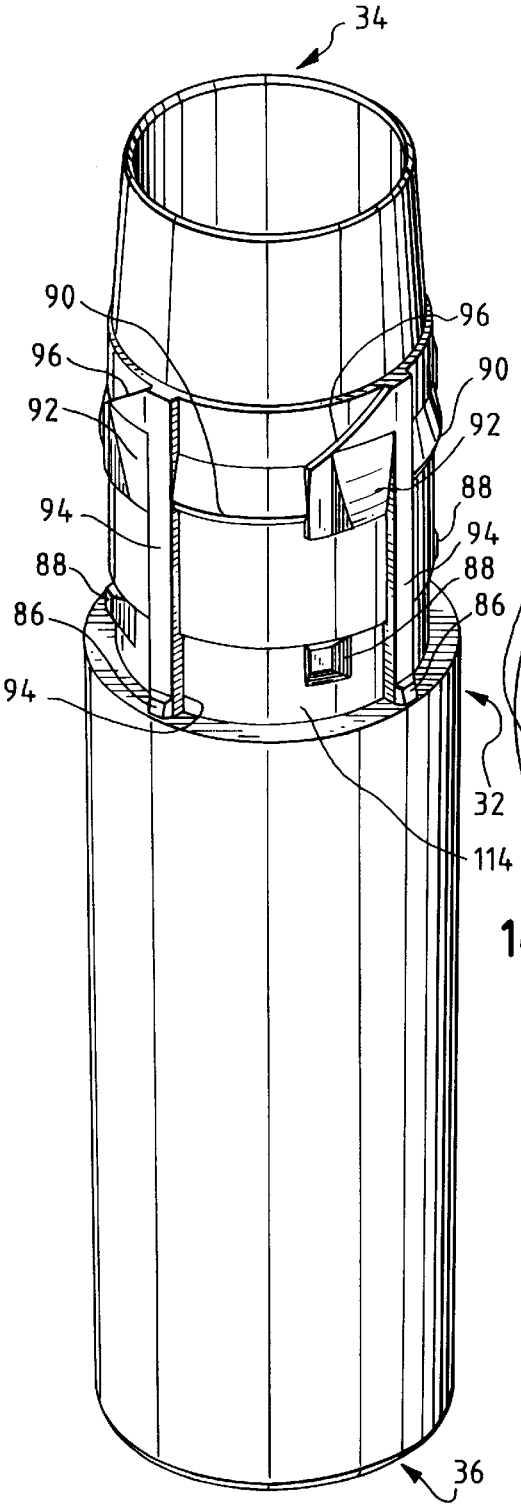
FIG. 9 is a top-side perspective view of the container body.

FIGS. 1 and 9 disclose the closure 30 and the container body 32 of the new telescopic pill dispenser. The container body has a tube shape. It has an open end 34 and a closed end 36 axially spaced from the open end.

The closure has a tube shape. The tube-shaped closure has an open end 38 axially opposite a closed end 40. The tube-shaped closure further has an opening 42 in a closure side wall 41. The closure open end 38 is telescopically inserted over the container body open end 34.

In the closed rotationally locked position 44 (FIGS. 15, 19), rotation of the closure relative to the container body is inhibited. Also, movement of the closure 30 longitudinally away from the container body 32 is inhibited. In the closed rotationally locked position, the closure seals closed the container body open end 34. The closure side wall opening 42 is completely blocked by a side wall 46 of the container body.

Figure 16:
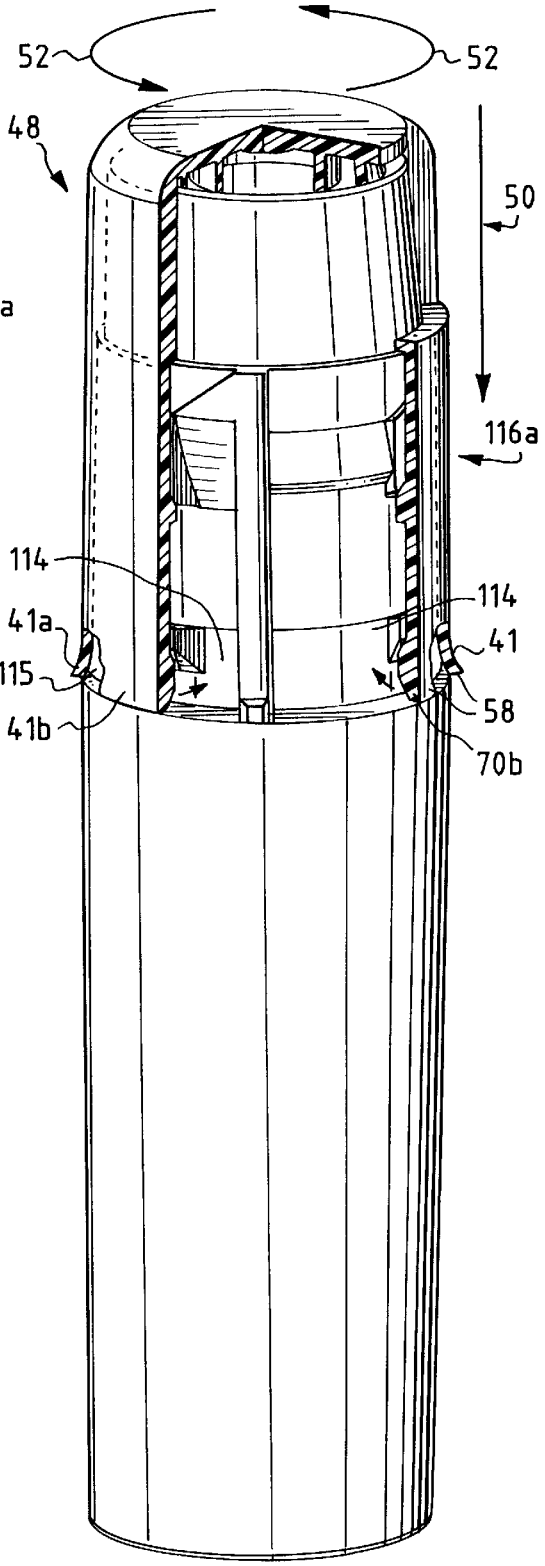
FIG. 16 is a side perspective view of the dispenser showing the closure coupled to the container body in the closed rotationally unlocked position wherein a portion of the side wall of the closure has been cut away.

A user adjusts the closure from the closed rotationally locked position 44 to an open position 47 (FIG. 18) by first adjusting the closure to a closed rotationally unlocked position 48 (FIG. 16). The closure is adjusted to the rotationally unlocked position by applying a force 50 on the closure relative to the container body to push the closure longitudinally in a direction towards the container body.

Figure 17:
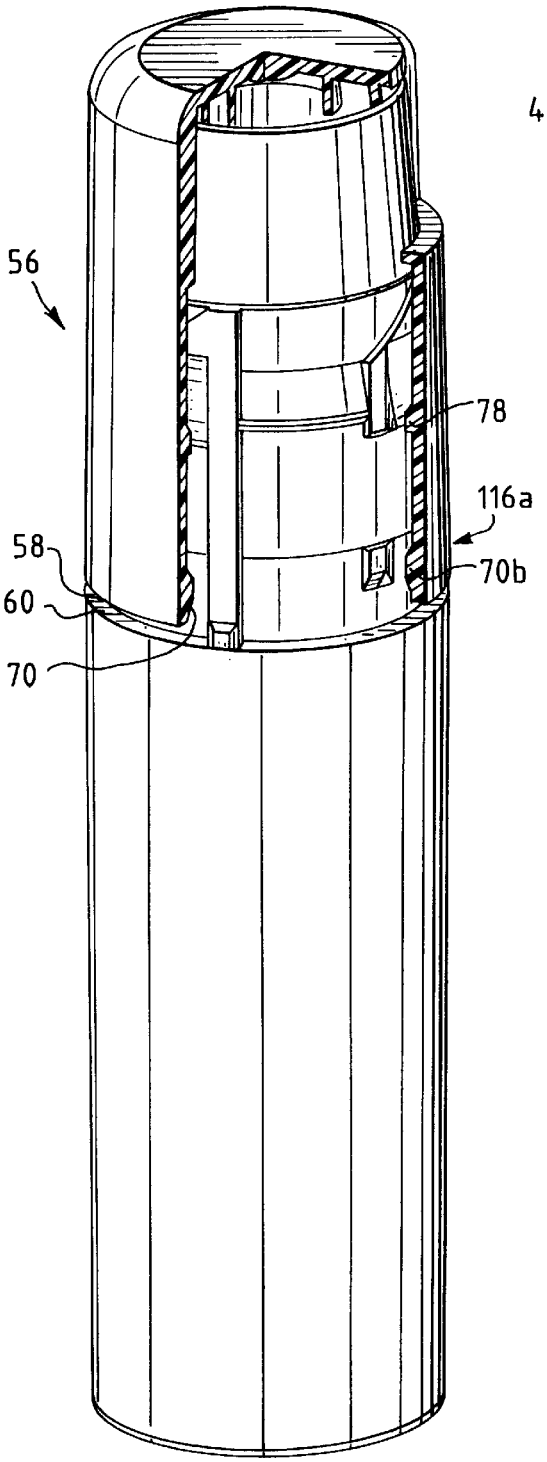
FIG. 17 is a side perspective view of the dispenser showing the closure coupled to the container body in the alignment position wherein a portion of the side wall of the closure has been cut away.

While the closure is in the unlocked position 48, a user rotates the closure in a direction of rotation 52. The user rotates until the closure and container body are in an alignment position 56 (FIG. 17). A user knows when the closure is in the alignment position because the rotation of the closure in the direction of rotation reaches a stop point and the user can no longer rotate the closure relative to the container body. Ceasing to continually apply the force 50 prior to adjusting the closure to the alignment position 56 allows the closure to readjust to the rotationally locked position 44.

Figure 18:
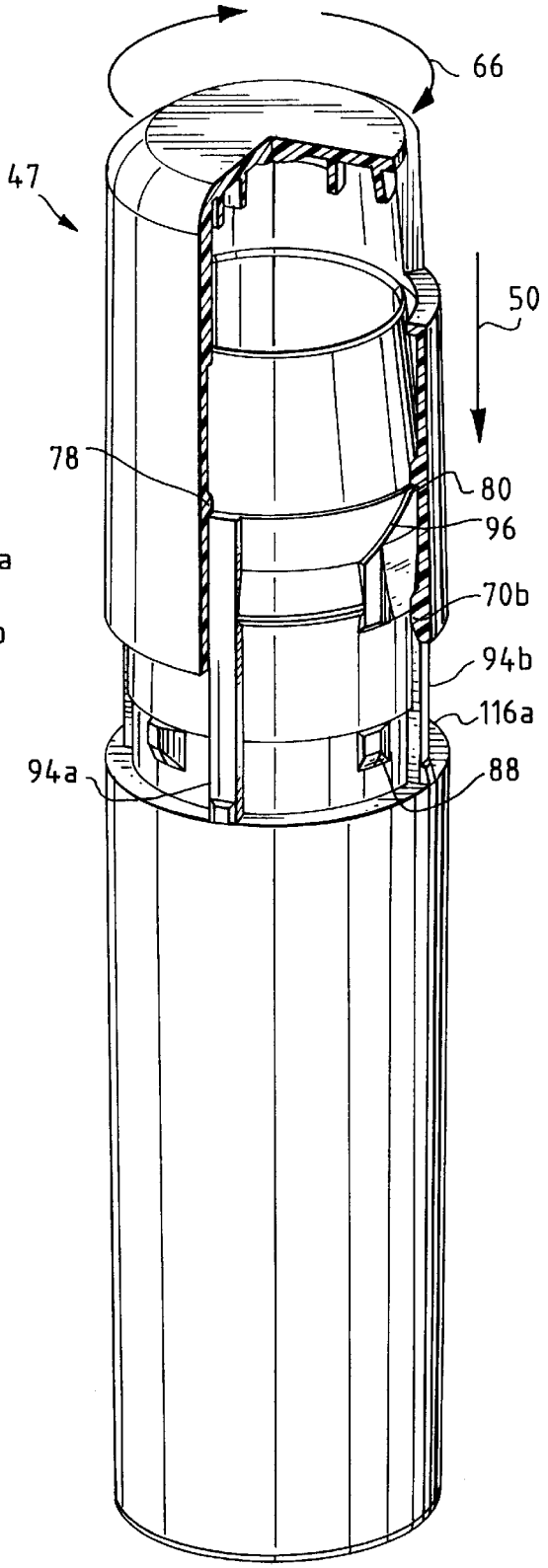
FIG. 18 is a side perspective view of the dispenser showing the closure coupled to the container body in the open position wherein a portion of the side wall of the closure has been cut away.

When the closure has reached the alignment position 56 (FIG. 17), a user may release the applied longitudinal force 50 on the closure. The closure will resiliently reconform so that the closure's annular end wall 58 is longitudinally spaced from a container body ledge surface 60. A user longitudinally moves the closure away from the container body until the closure reaches an axial stop point and is in the open position 47 (FIG. 18).

A user moves the closure from the open position 47 to the closed rotationally locked position 44 by moving the closure in the direction 50 longitudinally towards the container body. The movement of the closure towards the container body causes a mechanical interaction between the closure and the container body which causes the closure to rotate relative to the container body in a direction 66 opposite the direction of rotation. The rotation moves the closure out of the alignment position 56. The axial movement moves the closure to the closed rotationally locked position (see FIG. 15).

To obtain the various closure positions, the pill dispenser utilizes a series of interferences and ramps. Referring to FIGS. 2, 3, 4 and 7, the closure interferences include eight first closure protrusions 70. Each first closure protrusion has a sloped surface 72 facing in a direction relatively towards the closure open end 38, a sloped surface 74 facing in a direction relatively towards the closure closed end 40, and a side surface 76 facing radially inward and parallel to the closure's longitudinal axis (see FIG. 4).

Figure 4:
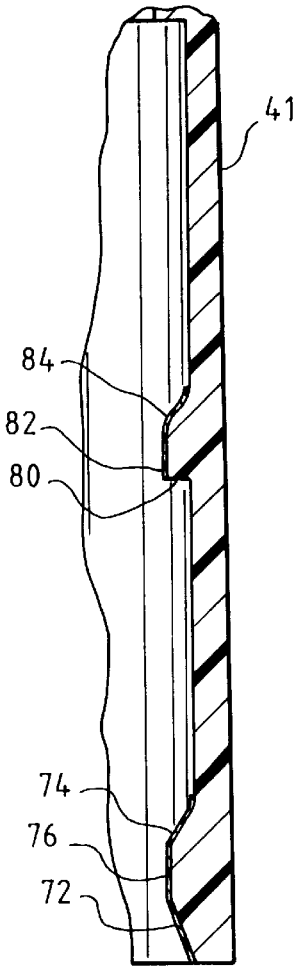
FIG. 4 is a blown-up view of a portion of the vertical cross-section of the closure shown in FIG. 2, detail F.
Figure 5:
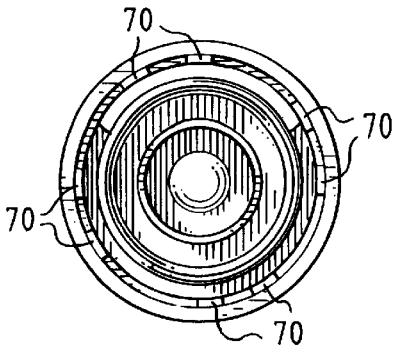
FIG. 5 is a view of the closure looking into the closure's open end.

Referring to FIG. 4, the first closure protrusion relatively closed-end-facing surface 74 slopes radially outward from the closure side wall interior surface and extends towards the closure open end. The first closure protrusion relatively open-end-facing surface 72 slopes radially outward from the closure side wall interior surface and extends towards the closure closed end 40. The first protrusion relatively open-end-facing surface 72 has a length about 1.5 times the length of the closures protrusion relatively closed-end-facing surface 74. The first closure protrusions 70 lie in the same circumferential plane.

Figure 6:
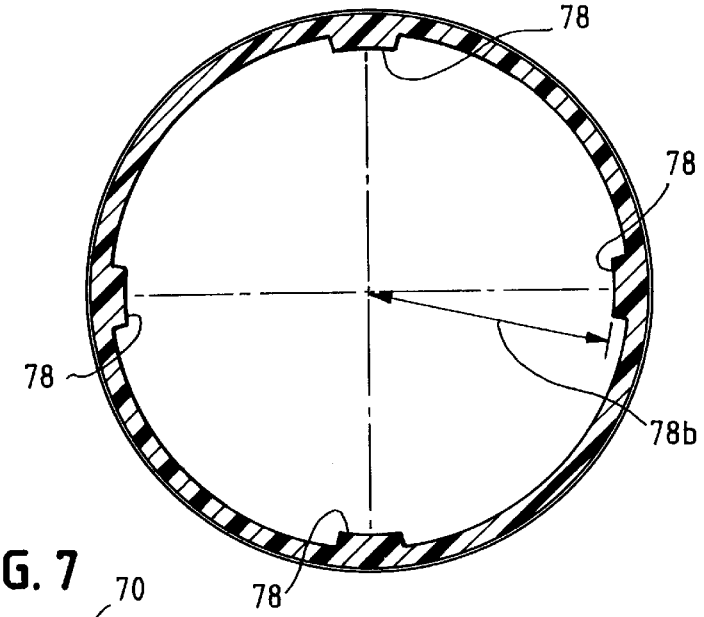
FIG. 6 is a horizontal cross-section of the closure taken along view lines E—E in FIG. 3.
Figure 7:
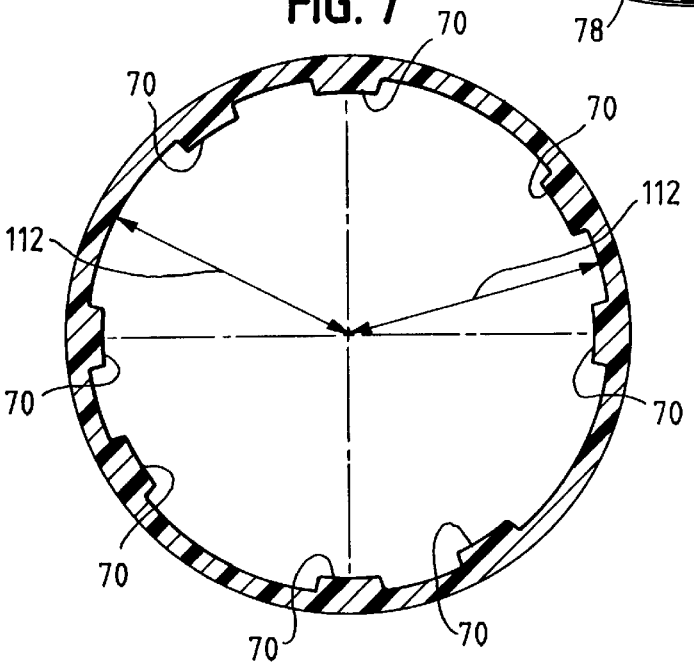
FIG. 7 is a horizontal cross-section of the closure taken along view lines D—D of FIG. 3.

The closure also has four second closure protrusions 78 (FIGS. 4, 6). The second closure protrusions 78 lie in the same circumferential plane and are equidistantly spaced. Each second closure protrusion 78 has a second closure protrusion relatively open-end-facing surface 80 perpendicular to the closure's longitudinal axis. Each protrusion has a side surface 82 parallel to the closure's axis. Each protrusion has a second closure protrusion relatively closed-end-facing surface 84 which slopes radially outward from the closure side wall's interior surface towards the closure open end.

Figure 10:
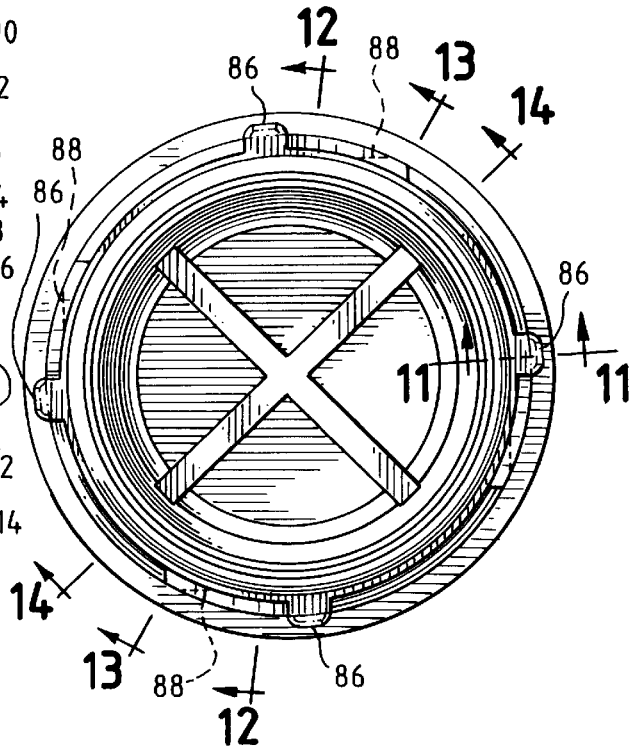
FIG. 10 is a top view of the container body looking into the container body's open end.
Figure 11:
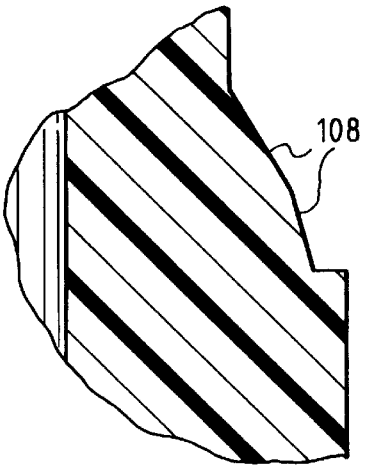
FIG. 11 is a blown-up view of a vertical cross-section of the container body taken along view lines D—D of FIG. 10.

Referring to FIGS. 9 and 10, the container body interferences include four first neck protrusions 86, four second neck protrusions 88, four third neck protrusions 90, four longitudinally extending ramps 92, four longitudinally extending splines 94, and four helical ramps 96 which extend both laterally and longitudinally. The four longitudinally extending splines 94 are equidistantly arranged along the circumference of the container body neck. The splines form four pairs of adjacent longitudinally extending splines.

Between each pair of adjacent splines is one of the four second neck protrusions 88. The second neck protrusions 88 all lie in the same circumferential plane. The second neck protrusions 88 provide an abutment to some of the first closure protrusions 70 and inhibit rotation of the closure relative to the container body when the closure is in the closed rotationally locked position (see FIG. 15).

Figure 14:
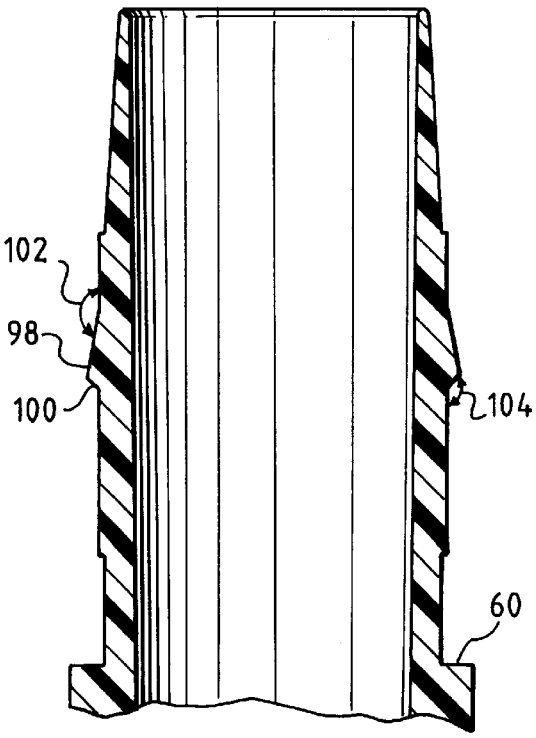
FIG. 14 is a vertical cross-section of the container body taken along view lines C—C of FIG. 10 wherein the cross-section discloses the neck portion and ledge surface of the container body.

Also between each pair of adjacent longitudinally extending splines is one of the four third neck protrusions 90. Each third neck protrusion has a third neck protrusion relatively open-end-facing surface 98 facing in the direction of the container body open end and sloping radially outward and towards the container body closed end (FIG. 14). Each third neck protrusion has a third neck protrusion relatively closed-end-facing surface 100 facing in the direction of the container body closed end and sloping radially outward and towards the container body open end. The third neck protrusion relatively closed-end-facing surface 100 is about 0.25 times the length of the third neck protrusion relatively open-end-facing surface 98. Additionally, the third neck protrusion relatively open-end-facing surface 98 forms an angle 102 with the container body's outer neck surface which is about 170°, whereas the third neck protrusion relatively closed-end-facing surface 100 forms an angle 104 with the container body outer surface which is about 135°. The third neck protrusions create an interference with the second closure protrusions to prevent the closure from moving axially away from the container body (see FIG. 15).

Between each pair of adjacent longitudinally extending splines is one of the four helical ramps 96. Each helical ramp extends longitudinally and laterally. The ramps interact with the second closure protrusions 78 to rotate the closure out of the alignment position when a user moves the closure axially towards the closure closed end 40 (see FIG. 18).

Figure 19:
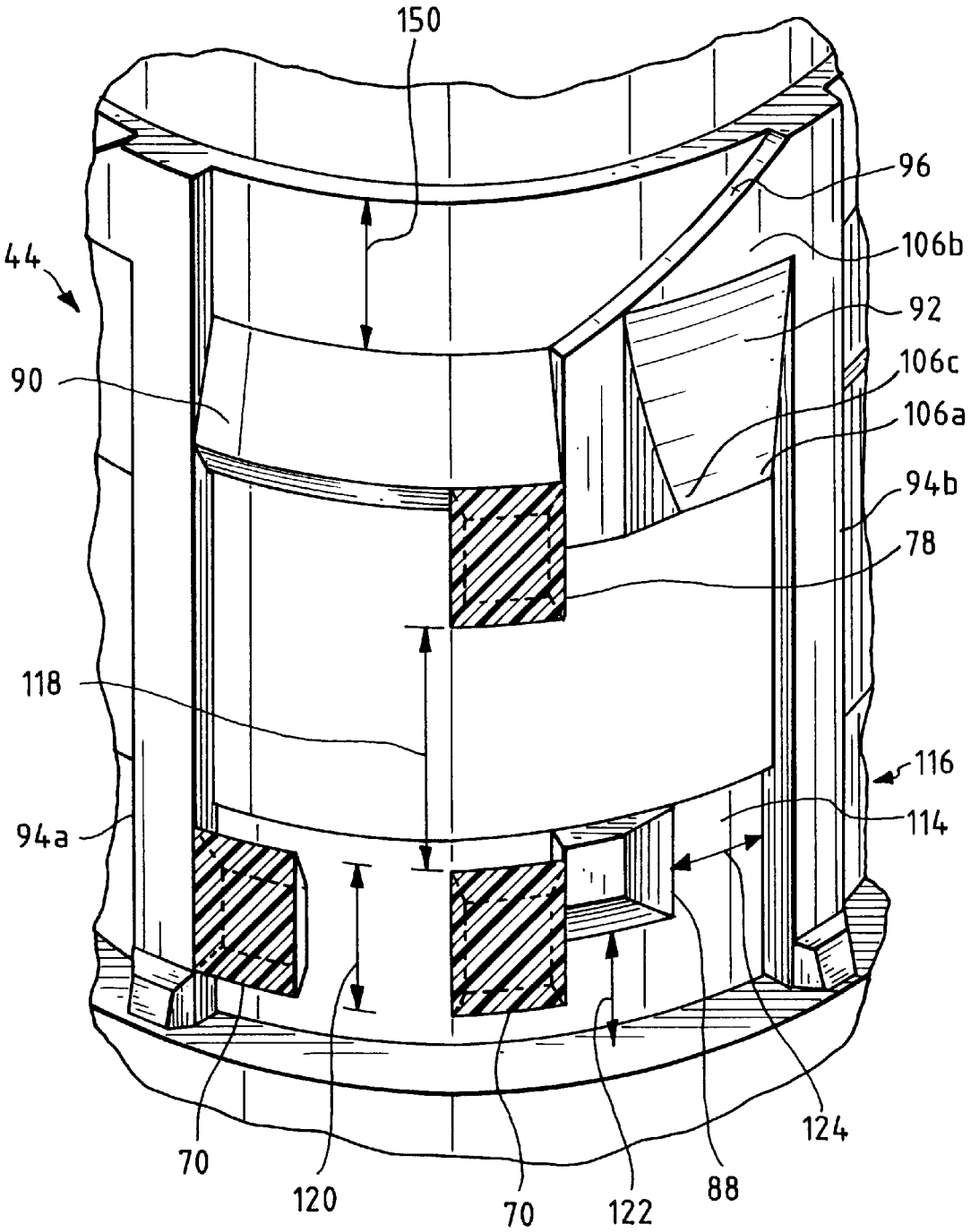
FIG. 19 is a top perspective view of the container body wherein the first and second protrusions on the interior surface of the closure can be seen interacting with the container body when the closure is in the closed rotationally locked position.

Additionally, one of the four longitudinally extending ramps 92 is between each pair of adjacent splines. The portion of the longitudinal ramp 106*a* closest to the container body closed end and closest to one of the longitudinally extending splines 94 is radially inward of the portion of the ramp 106*b* towards the container body open end (FIG. 19). The portion 106*a* is also radially inward of the portion of the ramp 106*c* closest to the container body closed end and farthest from another of the longitudinally extending splines 94. Each ramp 92 provides a longitudinal guide for a different one of each of the second closure protrusions 78. The longitudinal path allows the closure, once moved to an alignment position, to be moved longitudinally away from the container body and into an open position. The shape of the ramp 92 also aids in molding.

Figure 12:
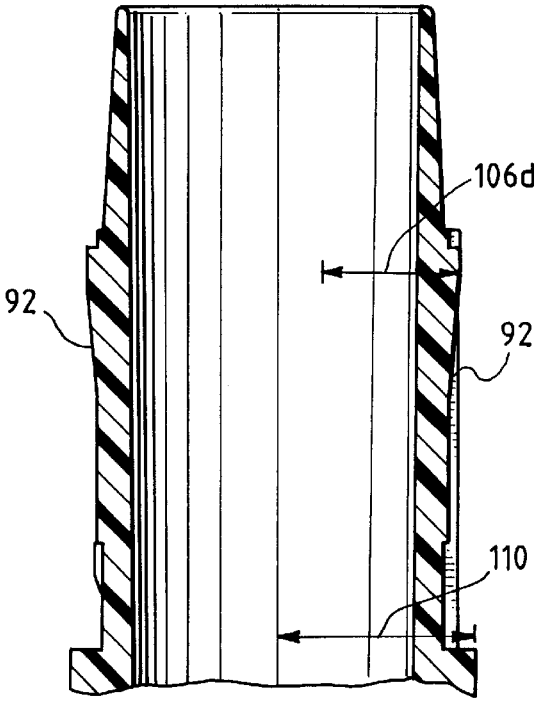
FIG. 12 is a vertical cross-section of the container body taken along view lines A—A of FIG. 10 wherein the cross-section discloses the neck portion and ledge surface of the container body.

The first neck protrusions 86 are disposed along the container body ledge surface 60. Each first neck protrusion 86 is at the base of a different one of the longitudinally extending splines. Each first neck protrusion has a sloped side surface 108. The side surface 108 is relatively facing towards the container body open end and slopes radially outward towards the container body closed end. A portion of each first neck protrusion side surface has an outer neck radius 110 (FIG. 12). Each outer neck radius is slightly larger than a plurality of closure internal radiuses 112 (FIG.

7). The differences in radius and the slope of surfaces 108 cause the first neck protrusions to provide a force on the annular closure end wall 58 and hold the annular closure end wall 58 longitudinally away from the container body ledge surface 60 (see FIG. 15). The displacement holds the closure in the closed rotationally locked position.

To move the closure to the closed rotationally unlocked position, a user simply applies a force to push the closure annular end wall 58 towards the container body ledge surface 60. The pushing force causes the closure open end to slide over the first neck protrusions (see FIG. 16). The first neck protrusions deform the closure annular end wall 58 and closure side wall 41 from round to squarish. The squarish shape is achieved because a portion of the closure side wall 41*a* at each first neck protrusion bulges outward. Also, an adjacent portion of the closure side wall 41*b* adjacent to the portion bulging outward deforms radially inward.

A lateral groove 114 between each pair of adjacent splines allows the closure side wall 41*b* to deform radially inward. The groove provides a space for the first closure protrusions during deformation (see FIG. 16).

Figure 15:
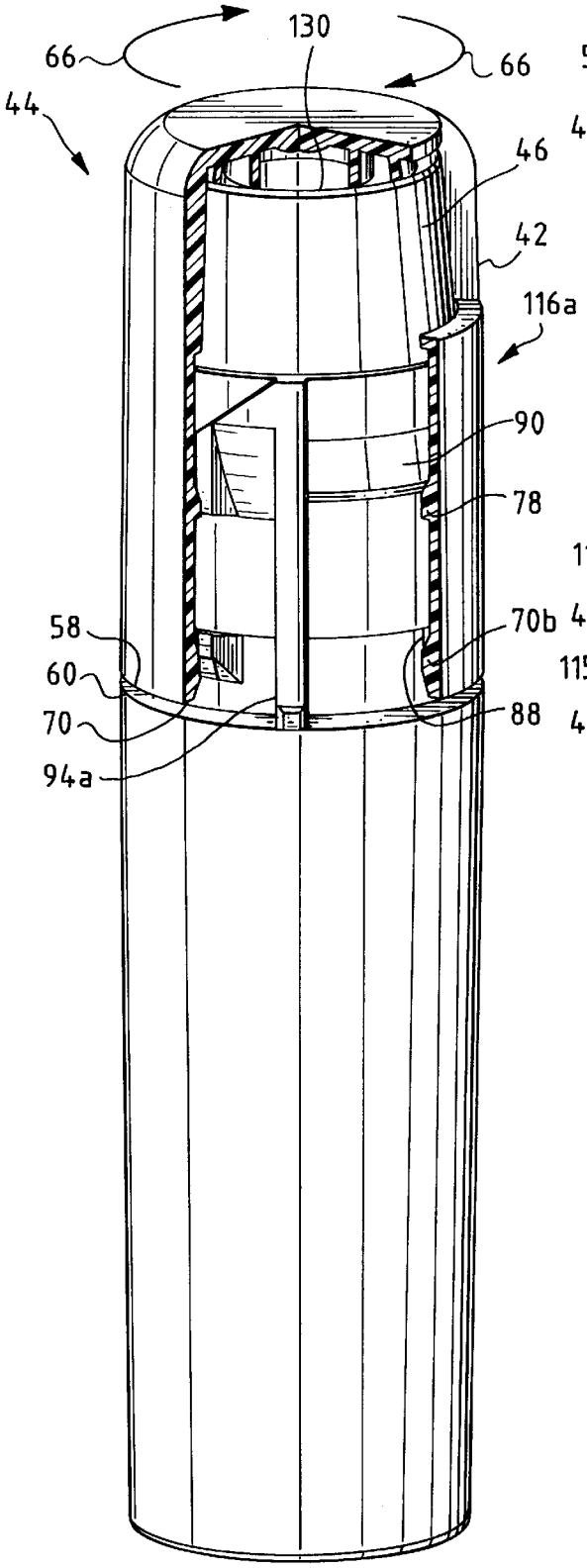
FIG. 15 is a side perspective view of the dispenser showing the closure coupled to the container body in the closed rotationally locked position wherein a portion of the side wall of the closure has been cut away.

When a user lets up on the applied force 50, the resilient forces of the closure annular end wall 58 and side wall 41 cause the closure side wall and annular end wall to reconform to the annular shape. The reconforming causes the closure side wall and end wall to slide along the first neck protrusions 86 away from the container body ledge surface. The sliding (spring action) places the first closure protrusions and second neck protrusions in the same horizontal plane. Thus, if the closure is not in the aligned position (FIG. 17), the closure will be in the closed rotationally locked position (FIG. 15). A slit 115, or notch, or a change of thickness at a portion of the closure side wall of course will change the closure side wall resilient forces and change the spring action.

Each pair of adjacent splines forms a rotational quadrant 116 (FIG. 19). There are four rotational quadrants. Each rotational quadrant is the same. Each rotational quadrant is bounded by a pair of the adjacent longitudinal splines. Each quadrant 116 has a pair of the first closure protrusions 70, one of the second closure protrusions 78, one of the second neck protrusions 88, one of the third neck protrusions 90, one of the helical ramps 96, one of the longitudinal ramps 92, a first lateral passage 118 and a first longitudinal passage 120, a second lateral passage 122 and a second longitudinal passage 124.

Figure 20:
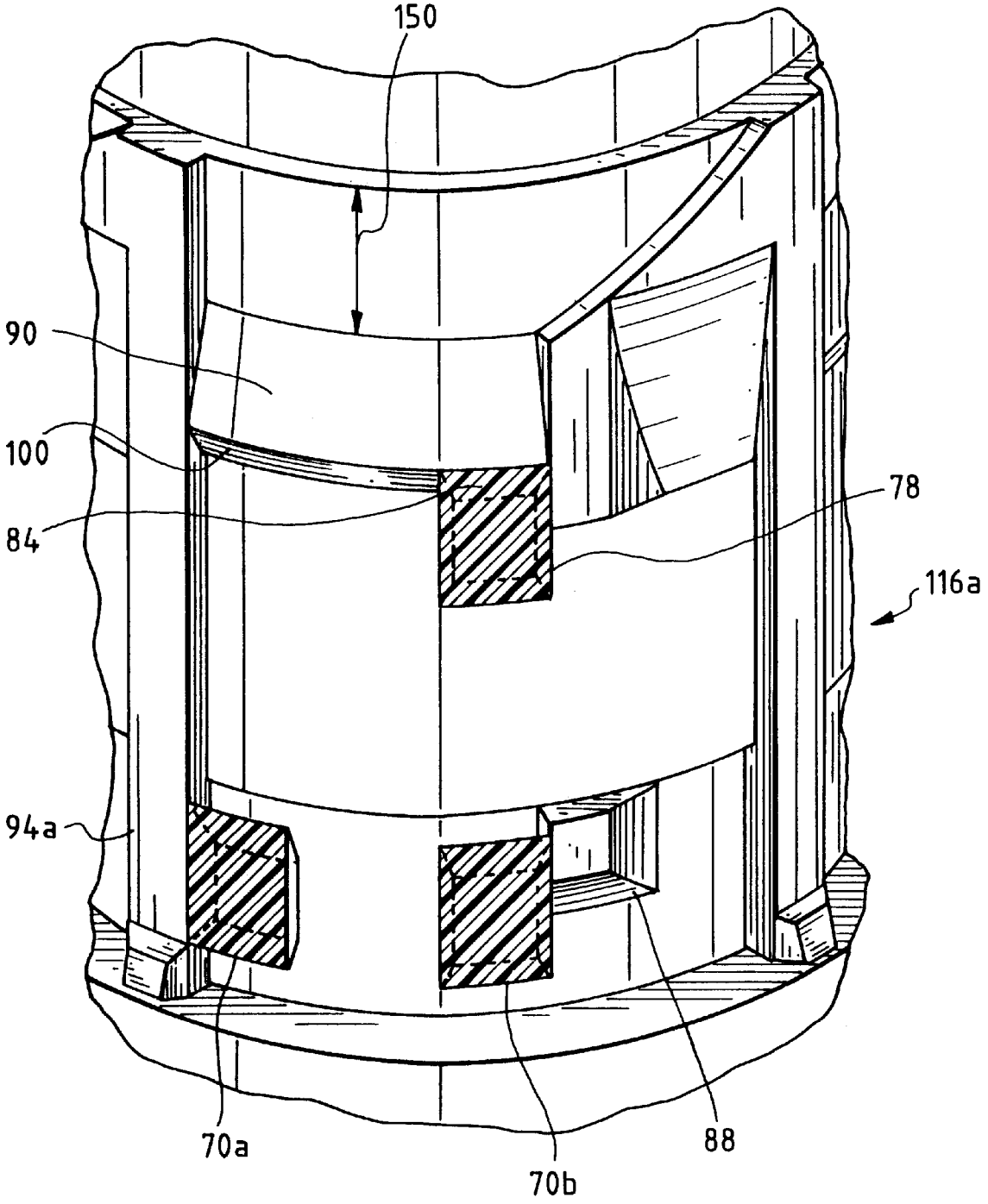
FIG. 20 is a top perspective view of the container body wherein the first and second protrusions on the interior surface of the closure can be seen interacting with the container body when the closure is in the closed rotationally locked position.

Looking at one of the quadrants 116*a* when the closure is in the closed rotationally locked position (FIGS. 15, 20), it can be seen that one of the adjacent longitudinal splines 94*a* is in the rotational path of one of the first closure protrusions 70*a*. Also, one of the second neck protrusions 88 is in the rotational path of another one of the first closure protrusions 70*b*. Further, one of the third neck protrusions 90 is in the longitudinal path of one of the second closure protrusions 78. The one longitudinal spline 94*a* being in the path of the one first closure protrusion 70*a* inhibits lateral movement of the closure in the direction 66 opposite the direction of rotation. The second neck protrusion 88 being in the path of the other first closure protrusion 70*b* inhibits lateral movement in the direction of rotation 52. The third neck protrusion 90 being in the longitudinal path of the second closure protrusion 78 prevents axial movement of the closure away from the container body.

Figure 21:
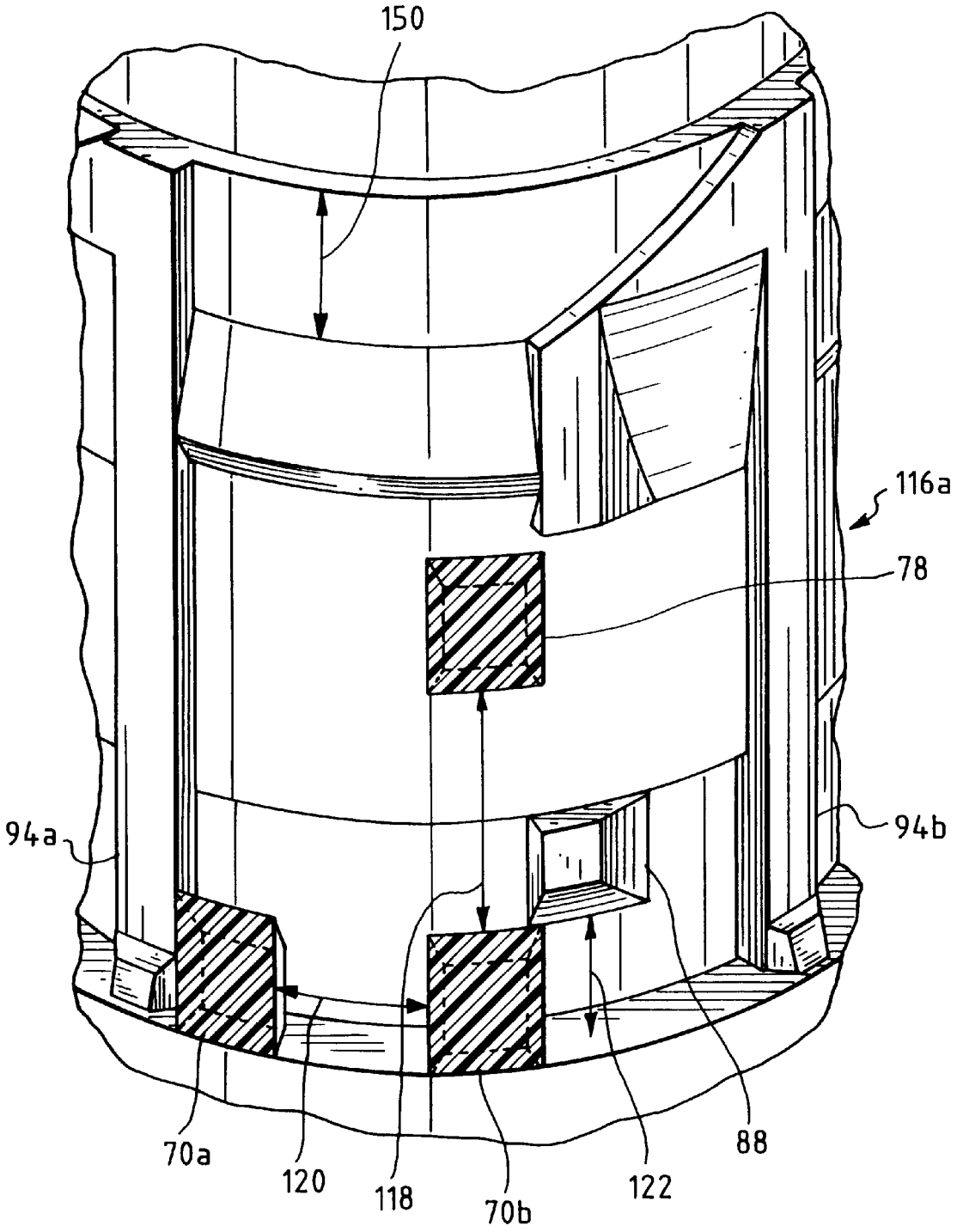
FIG. 21 is a top perspective view of the container body wherein the first and second protrusions on the interior surface of the closure can be seen interacting with the container body when the closure is in the closed rotationally unlocked position.
Figure 22:
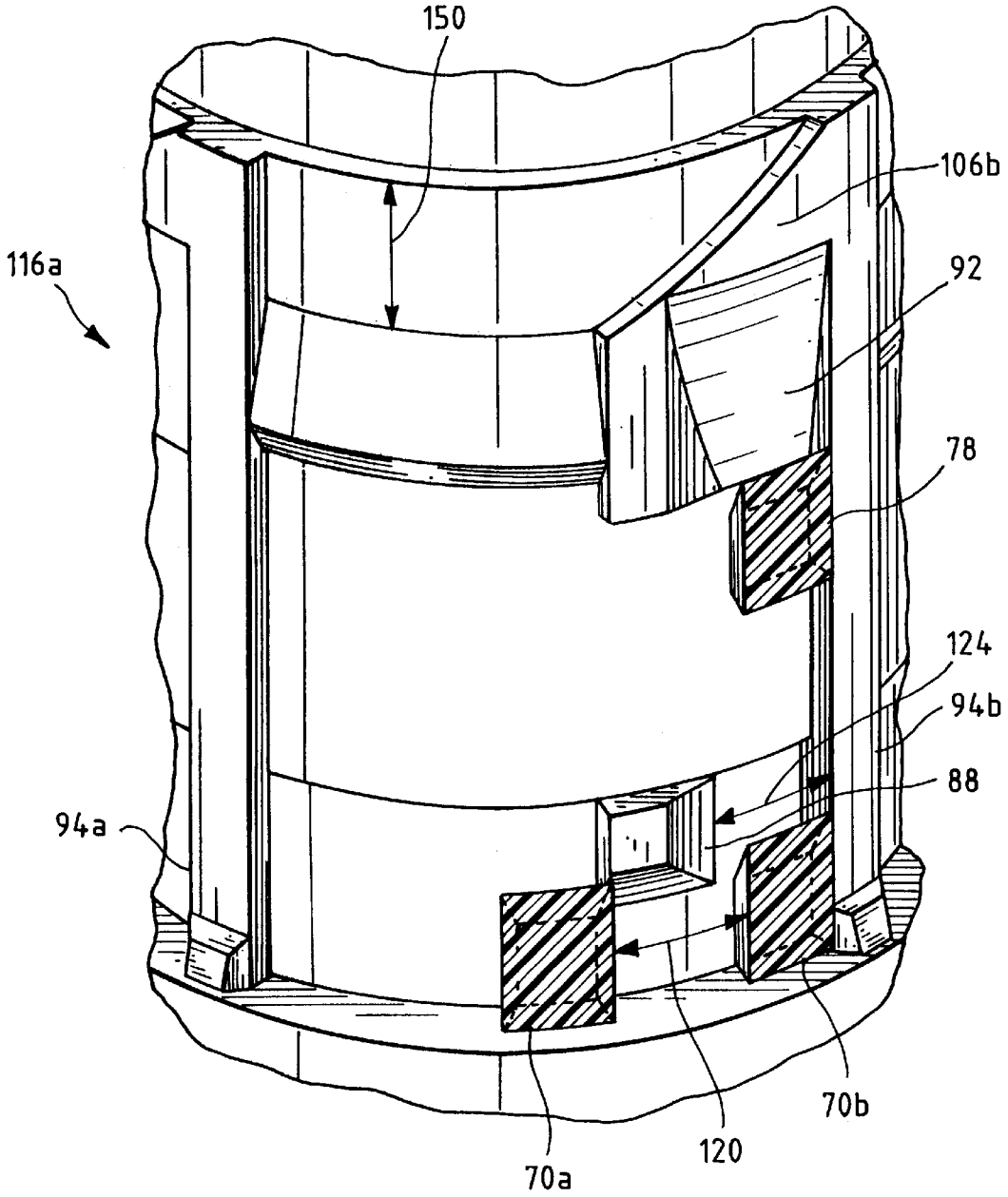
FIG. 22 is a top perspective view of the container body wherein the first and second protrusions on the interior surface of the closure can be seen interacting with the container body when the closure is in the alignment position.

In the closed rotationally unlocked position within the quadrant 116*a* (FIG. 21), the second neck protrusion 88 is aligned with the first lateral passage 118. The first closure protrusions 70*a*, 70*b* are aligned with the second lateral passage 122. A user can then rotate the first closure in the direction of rotation 52 to cause the second neck protrusion 88 to pass through the first lateral passage 118. After sufficient rotation, the other first closure protrusion 70*b* abuts up against the other longitudinal spline 94*b*. Further, the first vertical passage 120 will be aligned with the second neck protrusion 88. The other first closure protrusion 70*b* is aligned with the second longitudinal passage 124. This arrangement leaves the closure in the alignment position (see FIGS. 17, 22).

When the closure is adjusted from the alignment position (FIGS. 17, 22) to the open position (FIG. 18), within the quadrant 116*a*, the second neck protrusion 88 passes through the first vertical passage 120. The second closure protrusion 78 moves along the longitudinal ramp 92. The portion of the ramp 106*b* has an outer radius 106*d* (FIG. 12) slightly larger than an inner radius 78*b* formed by the second closure protrusion. The difference in radius slightly stretches the closure side wall. After sufficient longitudinal movement, the second closure protrusion 78 snaps into place. After snapping into place, the second closure protrusion relatively open-end-facing surface 80 abuts up against the helical ramp 96 (see FIG. 18).

When the closure is moved from the open position (FIG. 18) back to the closed rotationally locked position (FIGS. 15, 20), within the quadrant 116*a*, the second closure protrusion 78 moves laterally and longitudinally along the helical ramp 96. The second closure protrusion moves laterally in the direction 66 opposite the direction of rotation and longitudinally towards the container body. Eventually the second closure protrusion 78 snaps into place so that the second closure protrusion relatively closed-end-facing surface 84 abuts up against the third neck protrusion closed-end-facing surface 100.

A user, to move back to the open position, simply repeats the above-described steps.

Figure 8:
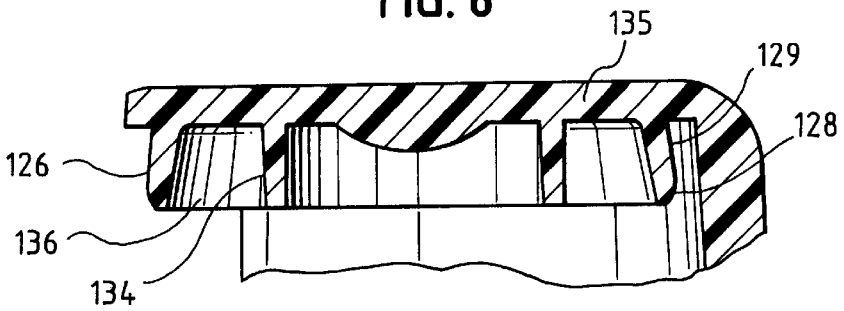
FIG. 8 is a blown-up view of a vertical cross-section of the closure shown in FIG. 2, detail H.

In addition to having child resistant features, the pill dispenser also has advantageous sealing features (see FIG. 8). The advantageous sealing features include an annular first inner side wall 126 which extends longitudinally from the closure closed end towards the closure open end. The first inner side wall extends into the open end of the container body when the closure is in the closed rotationally locked position (FIG. 15). It is important to note that the outer diameter of the closure first inner side wall 126 increases towards the closure open end. The increasing diameter allows for an end portion 128 (lip) of the first inner side wall to abut up against the interior of the container body at a place below the container body end wall 130. Another portion of the closure first inner side wall 129 having a reduced outer diameter towards the closure closed end ensures that, towards the closure closed end, clearance exists between the closure first inner side wall 126 and a portion of the container body interior side wall when the closure is in the closed position. The clearance allows for a good seal even when sizing of the closure and container body are slightly imperfect.

Figure 13:
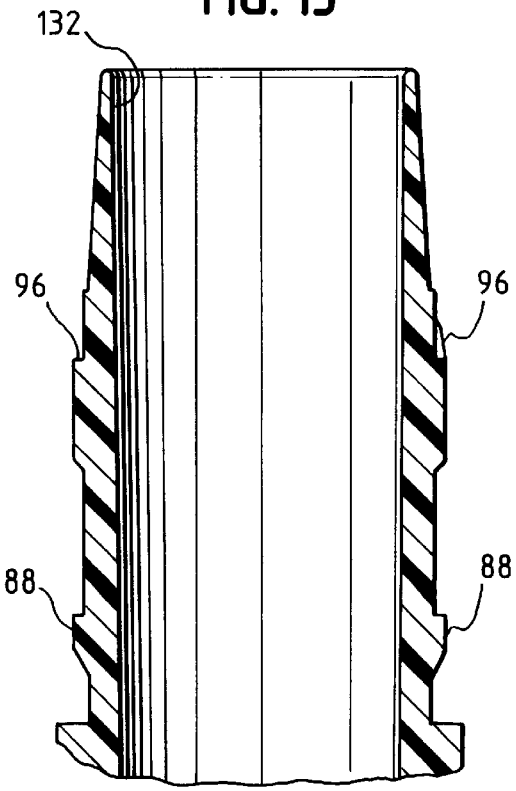
FIG. 13 is a vertical cross-section of the container body taken along view lines B—B of FIG. 10 wherein the cross-section discloses the neck portion, ledge surface and helical guide of the container body.

Preferably the end portion 128 of the closure first inner side wall has an outer diameter which is larger than the inner diameter formed by an interior surface of the container body side wall. The differences in diameter cause the resilient first inner closure side wall 126 to be compressed inwardly, producing a tight interference seal between the lip portion 128 and the portion of the interior surface of the container body side wall 132 (FIG. 13). The seal is improved by a tapering radially inward of the container body open end.

The closure also includes a second inner annular side wall 134 extending longitudinally away from the closure closed end wall 135 towards the closure open end. The second inner side wall 134 is radially inward of the first inner side wall. The second inner side wall helps prevent items from catching on the closure which otherwise might interfere with dispensing. An empty region 136 is provided between the first interior side wall and the second interior side wall so that the second interior side wall does not impede the resilience of the first interior side wall.

The above-described embodiment of the invention is merely an example in which the invention may be carried out. Other ways may also be possible and are within the scope of the following claims defining the invention.

I claim:

1. A small dry object dispenser comprising:

a closure, said closure having an open end and a closed end opposite said open end;

a closure side wall forming a part of said closure, said closure side wall having an opening;

an end wall forming a part of said closure, said end wall longitudinally opposite said closure open end;

a container body having a closed end and an opening, said opening longitudinally spaced from said closed end;

a container body side wall forming a part of said container body, said container body side wall adjacent to said closure side wall;

at least one rotational quadrant formed by said closure and said container body;

a plurality of interferences, a first lateral passage, a first vertical passage, a helical guide, and a longitudinal guide, all forming part of said rotational quadrant, wherein said closure is adjustable to an open position and, in said open position, a dispensing opening is formed by said opening in said closure side wall and said container body opening, and wherein said closure is adjustable to a closed rotationally locked position and, in said closed rotationally locked position, said dispensing opening is closed and unrestricted rotation of the closure relative to the container body is inhibited, and wherein said closure is adjustable to a closed rotationally unlocked position and, in said closed rotationally unlocked position, said closure is less rotationally restricted than when said closure is in said closed rotationally locked position and, in said closed rotationally unlocked position, said closure end wall is longitudinally closer to said container body closed end than when said closure is in said closed rotationally locked position, and wherein the closure side wall remains adjacent to said container body side wall during an adjustment of said closure from said closed rotationally locked position, then to said closed rotationally unlocked position, then to said open position, and then back to said closed rotationally locked position.

2. The dispenser of claim 1, further comprising:

a closure first inner side wall, said closure first inner side wall being radially inward of said closure side wall;

a first portion of said closure first inner side wall having a greater outer diameter than a second adjacent portion of said closure first inner side wall, said second adjacent portion being closer to said closure closed end than is said first portion having the greater diameter, wherein in said closed rotationally locked position, the first portion of said closure first inner side wall abuts up against an interior surface of said container body side wall and a clearance exists between the second adjacent portion of the closure first inner side wall and an interior surface of the container body side wall.

3. The dispenser of claim 1 further comprising:

a plurality of protrusions arranged around an exterior surface of said container body, wherein in said closed rotationally locked position, a portion of each of said plurality of protrusions has an outer radius greater than inner radiuses formed by portions of an interior surface of said closure, and wherein in said closed rotationally unlocked position, said portions of the interior surface of said closure side wall are adjacent to the portion of each of said plurality of protrusions, and wherein said plurality of protrusions provide means for deforming said closure side wall out of a shape when said closure is in said closed rotationally unlocked position, and wherein the closure side wall will reconform to the shape when the closure adjusts from the closed rotationally unlocked position to the closed rotationally locked position.

4. The dispenser of claim 3 wherein:

said helical guide provides means for rotating said closure in a direction opposite a direction of rotation as a user applies a force on said closure to move said closure longitudinally towards said container body.

5. The dispenser of claim 4 wherein said longitudinal guide enables one of said plurality of interferences to abut up against a surface of said helical guide.

6. The dispenser of claim 5 further comprising:

a plurality of pairs of longitudinally extending splines;

a plurality of rotational quadrants, wherein each rotational quadrant is laterally bounded by a different pair of said pairs of adjacent longitudinally extending splines.

7. The dispenser of claim 6 wherein said interferences comprise:

two adjacent protrusions which form a longitudinal passage;

two adjacent protrusions which form a lateral passage;

a protrusion exclusive of the two adjacent protrusions forming the longitudinal passage and exclusive of the two protrusions forming the lateral passage, wherein one of said adjacent protrusions forming the longitudinal passage and one of said two other adjacent protrusions forming the lateral passage are the same.

8. The dispenser of claim 7 wherein said protrusion, exclusive of the two adjacent protrusions forming the longitudinal passage, forms a second vertical passage with one longitudinally extending spline from said pairs of splines.

9. The dispenser of claim 8 further comprising:

a ledge surface formed by said container body, said ledge surface bounding a longitudinal end of at least one of said rotational quadrants;

a laterally extending chasm defined by a surface of said container, wherein said laterally extending chasm is adjacent to at least one of said protrusions when said closure is in the closed rotationally unlocked position, and wherein said ledge surface and protrusion, exclusive of said two adjacent protrusions forming the longitudinal passage, form a second lateral passage which is part of the at least one rotational quadrant.

* * * * *